US005775921A

United States Patent [19]

Chou

[11] Patent Number: 5,775,921

[45] Date of Patent: Jul. 7, 1998

[54] ELECTRICAL PLUG

[76] Inventor: Jonie Chou, 9F-4, No. 232, Chung Ho Road, Chung Ho City, Taipei Hsien, Taiwan

[21] Appl. No.: 630,574

[22] Filed: Apr. 10, 1996

[51] Int. Cl.[6] ..... H01R 39/00

[52] U.S. Cl. ..... 439/21

[58] Field of Search ..... 439/18, 20–26, 439/11, 13, 27, 28, 106

[56] References Cited

U.S. PATENT DOCUMENTS

| | | | |
|---|---|---|---|
| 1,613,647 | 1/1927 | Davies et al. | 439/22 |
| 2,542,935 | 2/1951 | McElroy | 439/27 |
| 2,570,784 | 10/1951 | Ferguson | 439/27 |
| 2,654,869 | 10/1953 | Mudd, Jr. | 439/27 |
| 2,898,572 | 8/1959 | Shinn | 439/22 |
| 4,927,376 | 5/1990 | Dickie | 439/484 |
| 5,249,970 | 10/1993 | Jennings | 439/11 |
| 5,399,093 | 3/1995 | Schneider et al. | 439/21 |
| 5,595,503 | 1/1997 | Pittman et al. | 439/11 |

*Primary Examiner*—Gary F. Paumen
*Attorney, Agent, or Firm*—Bacon & Thomas

[57] ABSTRACT

An electrical plug which includes an insulative bottom shell which holds a metal sleeve at the center, a first annular metal cushion spaced around the metal sleeve, and second annular metal cushion spaced around the first annular metal cushion; an insulative upper shell covered on the bottom shell and having a circular opening; and electrical cable having two electrical wires respectively connected to the metal sleeve and the first annular metal cushion, and a grounding wire connected to the second annular metal cushion; and a rotary cap revolvably mounted within the circular opening of the upper shell which holds two metal contact blades, which are maintained in contact with the metal sleeve and the first annular metal cushion, and a grounding prong, which is maintained in contact with the second annular metal cushion; wherein the metal contact blades and grounding prong of the rotary cap are respectively and constantly maintained in contact with the metal sleeve and the annular metal cushions when the rotary cap is turned within the circular opening of the upper shell.

8 Claims, 3 Drawing Sheets

ELECTRICAL PLUG

BACKGROUND OF THE INVENTION

The present invention relates to electrical plugs, and relates more particularly to such an electrical plug which can be conveniently adjusted to change the positions of the metal contact blades and the grounding prong so as to fit different installation conditions.

The contact metal blades of a regular electrical plug are commonly disposed in line with the electrical cable thereof. Therefore, the electrical cable must be bent in a particular direction when the electrical plug is installed in an electrical socket in a narrow area or behind a furniture. However, the insulator tends to be broken if the electrical cable is deformed, thereby causing a short circuit. U.S. Pat. No. 4,927,376, issued to Dickie, disposes an electrical plug adapted for installation in a narrow space. However, this structure of electrical plug fits only one particular direction.

SUMMARY OF THE INVENTION

The present invention has been accomplished to provide an electrical plug which eliminates the aforesaid problem. It is one object of the present invention to provide an electrical plug which is suitable for installation in a narrow area. It is another object of the present invention to provide an electrical plug which can be conveniently adjusted to change the positions of the metal contact blades and the grounding prong so as to fit different installation conditions. According to one aspect of the present invention, the electrical plug comprises an insulative bottom shell, the bottom shell comprising an upright stub tube on the inside, the upright stub tube having a side opening, a metal sleeve mounted within the upright stub tube, a first upright annular flange on the inside around the upright stub tube, the first upright annular flange having a first side opening corresponding to the side opening of the upright stub tube and a second side opening 134, a first annular groove defined within the first upright annular flange around the upright stub tube, a plurality of first upright rods disposed in the first annular groove, a first annular metal cushion mounted within the first annular groove and supported on the first upright rods, and a cable hole at one end; an insulative upper shell covered on the bottom shell, the upper shell comprising a circular opening, an inward coupling flange suspending above and spaced around the circular opening, and a cable hole at one end matched with the cable hole of the bottom shell; a rotary cap turned within the circular opening of the upper shell, the rotary cap comprising a first slot, a first metal contact blade mounted in the first slot and having an arched tail disposed in contact with the first annular metal cushion of the bottom shell, a second slot, a second metal contact blade mounted in the second slot and having a rounded coupling end fitted into the metal sleeve of the bottom shell, and an outward coupling flange raised around the periphery and coupled to the inward coupling flange of the upper shell; and an electrical cable inserted through the cable hole of the bottom shell and the cable hole of the upper shell, comprising a first electrical wire inserted through the first side opening of the first upright annular flange and connected to the metal sleeve, and a second electrical wire inserted through the second side opening of the first upright annular flange and connected to the first annular metal cushion. According to another aspect of the present invention, the bottom shell further comprises a second upright annular flange on the inside around the first upright annular flange, the second upright annular flange having a side opening, a second annular groove defined within the second upright annular flange around the first upright annular flange, a plurality of second upright rods disposed in the second annular groove, and a second annular metal cushion mounted within the second annular groove and supported on the second upright rods; the electrical cable further comprises a grounding wire inserted through the side opening of the second upright annular flange and connected to the second annular metal cushion; the rotary cap further comprises a third slot, and a grounding prong mounted in the third slot and having a T-shaped tail disposed in contact with the second annular metal cushion.

DETAILED DESCRIPTION OF THE PREFERRED EMBODIMENT

Figure 1:
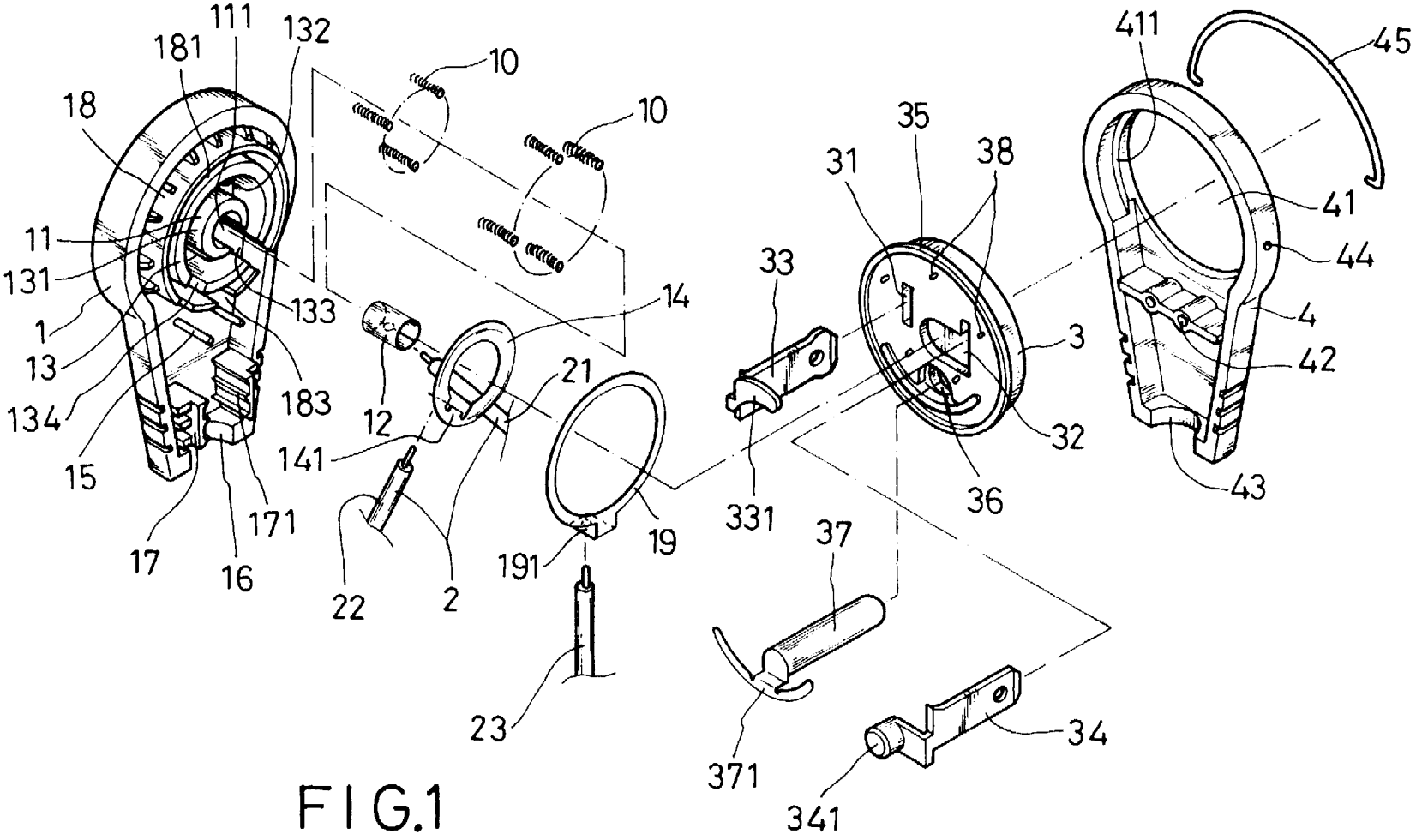
FIG. 1 is an exploded view of an electrical plug according to the present invention.
Figure 2:
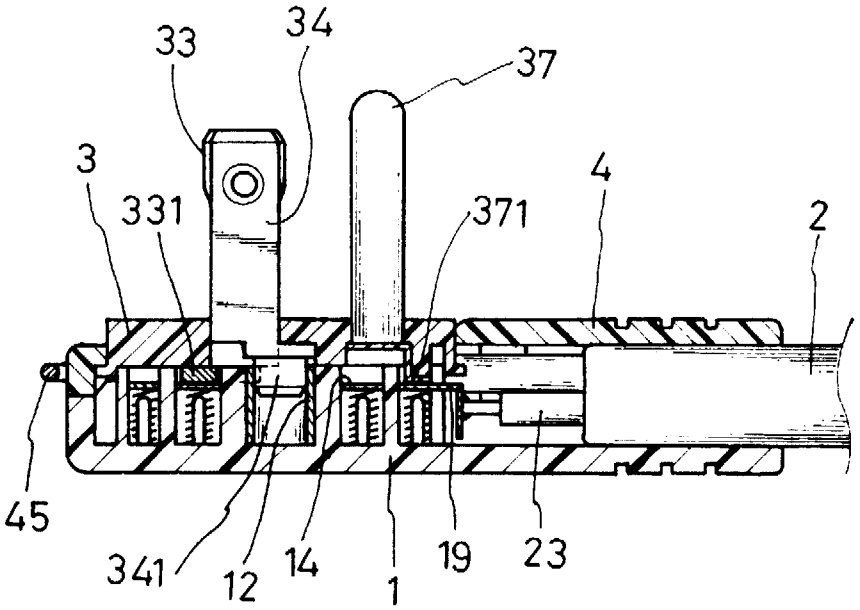
FIG. 2 is a sectional assembly view of the electrical plug shown in FIG. 1.

Referring to FIGS. 1 and 2, an electrical plug in accordance with the present invention is generally comprised of a bottom shell 1, an electrical cable 2, a rotary cap 3, and an upper shell 4.

The bottom shell 1 is an insulative covering comprising an upright stub tube 11 on the inside, the upright stub tube 11 having a side opening 111, a metal sleeve 12 mounted within the upright stub tube 11, a first upright annular flange 13 on the inside around the upright stub tube 11, the first upright annular flange 13 having a first side opening 133 corresponding to the side opening 111 of the upright stub tube 11 and a second side opening 134, a first annular groove 131 defined within the first upright annular flange 13 around the upright stub tube 11, a plurality of first upright rods 132 disposed in the first annular groove 131, a first annular metal cushion 14 mounted within the first annular groove 131 and supported on the first upright rods 132 and having a connecting tip 141, a plurality of inside locating pins 15 on the inside, a cable hole 16 at one end, two clamping flanges 17 bilaterally disposed in the cable hole 16 and having respective ribs 171, a second upright annular flange 18 on the inside around the first upright annular flange 13, the second upright annular flange 18 having a side opening 183, a second annular groove 181 defined within the second upright annular flange 18 around the first upright annular flange 13, a plurality of second upright rods 182 (not shown) disposed in the second annular groove 181, and a second annular metal cushion 19 mounted within the second annular groove 181 and supported on the second upright rods 182 and having a connecting tip 191.

The electrical cable 2 is inserted through the cable hole 16 into the bottom shell 1 and held in place by the clamping flanges 17, comprised of a first electrical wire 21, a second electrical wire 22, and a grounding wire 23. The first electrical wire 21 is inserted through the side opening 183 of the second upright annular flange 18 and the first side opening 133 of the first upright annular flange 13 and the side opening 111 of the upright stub tube 11, and then connected to the metal sleeve 12. The second electrical wire 22 is inserted through the side opening 183 of the second upright annular flange 18 and the second side opening 134 of the first upright annular flange 13, and then connected to the connecting tip 141 of the first annular metal cushion 14. The grounding wire 23 is inserted through the side opening 183 of the second upright annular flange 18, and then connected to the connecting tip 191 of the second annular metal cushion 19.

The rotary cap 3 is a circular insulative plate comprising a first slot 31, a first metal contact blade 33 mounted in the first slot 31 and having an arched tail 331 raised at one end at right angles and adapted for fitting over the first annular metal cushion 14, a second slot 32, a second metal contact blade 34 mounted in the second slot 32 and having a rounded coupling end 341 adapted for fitting into the metal sleeve 12, an outward coupling flange 35 raised around the periphery and adapted for engagement with the upper shell 4, a third slot 36, and a grounding prong 37 mounted in the third slot 36 and having a T-shaped tail 371 adapted for contact with the second annular metal cushion 19.

The upper shell 4 is an insulative covering fitting over the bottom shell 1, comprising a circular opening 41, which receives the rotary cap 3, an inward coupling flange 411 adapted for engagement with the outward coupling flange 35 of the rotary cap 3, a plurality of pin holes 42 adapted for engagement with the locating pins 14 of the bottom shell 1, a cable hole 43 at one end adapted for matching with the cable hole 16 of the bottom shell 1 for the passing of the electrical cable 2.

Furthermore, a plurality of spring members 10 are respectively mounted around the first upright rods 132 and the second upright rods 182 to support the first annular metal cushion 14 and the second annular metal cushion 19 above the first upright rods 132 and the second upright rods 182, and to force the first annular metal cushion 14 and the second annular metal cushion 19 into contact with the arched tail 331 of the first metal contact blade 33 and the T-shaped tail 371 of the grounding prong 37 respectively. The rotary cap 3 further comprises a plurality of raised portions 38 raised from the inside wall and adapted for pressing on the first annular metal cushion 14 and the second annular metal cushion 19 respectively.

Figure 4:
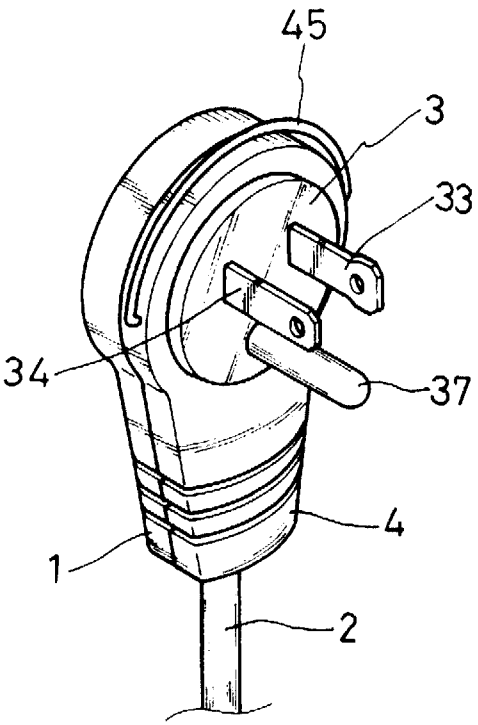
FIG. 4 is an elevational view of of the electrical plug according to the present invention.

Referring to FIG. 4 and FIGS. 1 and 2 again, the assembly process of the electrical plug is simple and outlined hereinafter. The metal contact blades 33, 34 and the grounding prong 37 are respectively fastened to the respective slots 31, 32, 36 of the rotary cap 3, then the rotary cap 3 is revolvably coupled to the circular opening 41 of the upper shell 4, and then the spring members 10 are respectively mounted on the upright rods 132, 182, and then the metal sleeve 12 and the annular metal cushions 14, 19 are respectively fastened to the electrical wires 21, 22 and grounding wire 23 of the electrical cable 2 and mounted in the upright stub tube 11, first annular groove 131 and second annular groove 181 of the bottom shell 1, and then the upper shell 4 is fastened to the bottom shell 1 by fitting the locating pins 15 into the pin holes 42, permitting the electrical cable 2 to extend out of the bottom shell 1 and the upper shell 4 through the cable holes 16, 46, and then the connecting area between the bottom shell 1 and the upper shell 4 are sealed by a high-frequency heat sealing apparatus. When the rotary cap 3 is turned within the circular opening 41 of the upper shell 4 through any desired angle, the arched tail 331 of the first metal contact blade 33 is maintained in contact with the first annular metal cushion 14, the T-shaped tail 371 of the grounding prong 37 is maintained in contact with the second annular metal cushion 19, and the rounded coupling end 341 of the second metal contact blade 34 is maintained in contact with the metal sleeve 12. Therefore, the rotary cap 3 can be turned within the circular opening 41 of the upper shell 4 to change the positions of the metal contact blades 33, 34 and the grounding prong 37 to fit the angular position of the electrical socket.

Referring to FIG. 4 and FIG. 1 again, two tie holes 44 are made on the upper shell 4 at two opposite locations, and a lifting handle 45 is fastened with its two opposite ends to the tie holes 44. Through the lifting handle 45, the electric plug can be conveniently disconnected from the electric socket.

Figure 3:
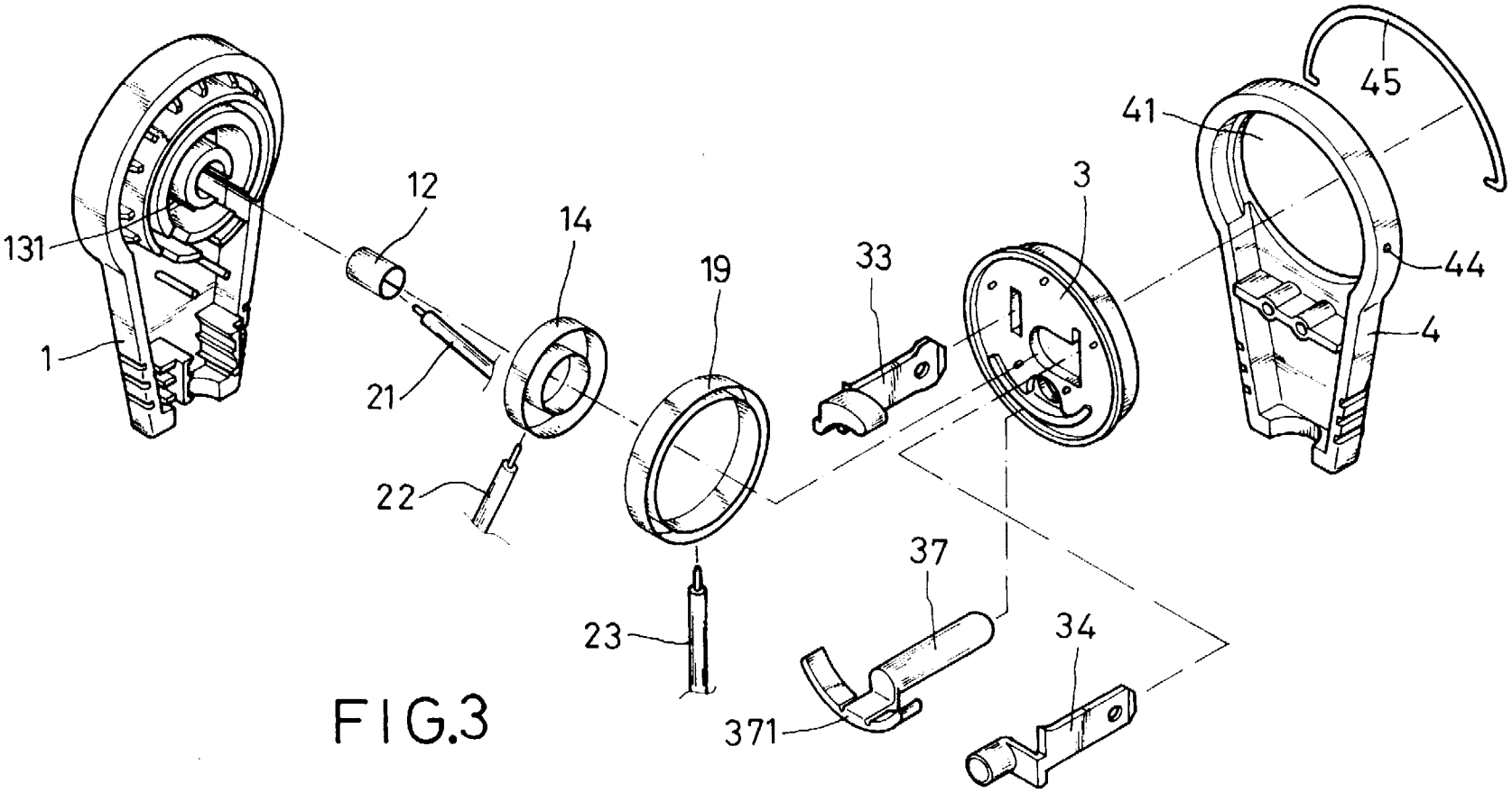
FIG. 3 is an exploded view of an alternate form of the electrical plug of the present invention.

FIG. 3 shows an alternate form of the present invention, in which the metal wall of the first annular metal cushion 14 is made of hollow structure having a substantially U-shaped cross section, and adapted for fitting into the first annular groove 131; the metal wall of the second annular metal cushion 19 is made of hollow structure having a substantially U-shaped cross section, and adapted for fitting into the second annular groove 181; the depth of the arched tail 331 of the first metal contact blade 33 and the depth of the T-shaped tail 371 of the grounding prong 37 are relatively increased so that they can be positively maintained in contact with the first annular metal cushion 14 and the second annular metal cushion 19.

It will be understood that the drawings are designed for purposes of illustration only, and are not intended as a definition of the limits and scope of the invention disclosed.

What the invention claimed is:

1. An electrical plug comprising:

an insulative bottom shell, said bottom shell comprising an upright stub tube, said upright stub tube having a first side opening; a metal sleeve mounted within said upright stub tube; a first upright annular flange extending around said upright stub tube, said first upright annular flange having a second side opening corresponding to the first side opening of said upright stub tube and a third side opening, a first annular groove defined between said first upright annular flange and said upright stub tube; a plurality of first upright rods disposed in said first annular groove; a first annular metal cushion mounted within said first annular groove and supported on said first upright rods; and a first cable hole at one end;

an insulative upper shell covering said bottom shell, said upper shell comprising a circular opening; an inward coupling flange spaced around said circular opening; and a second cable hole at one end located adjacent to said first cable hole;

a rotary cap rotatably located within the circular opening of said upper shell, said rotary cap comprising a first slot; a first metal contact blade mounted in the rotating cap and extending through said first slot, the first metal contact blade having an arched tail disposed in contact with the first annular metal cushion of said bottom shell; a second slot; a second metal contact blade mounted in said rotary cap and extending through said second slot, the second metal contact blade having a rounded coupling end in contact with the metal sleeve of said bottom shell; and an outward coupling flange around a periphery and coupled to the inward coupling flange of said upper shell; and an electrical cable inserted through the first and second cable holes, comprising a first electrical wire inserted through the second side opening of said first upright annular flange and connected to said metal sleeve, and a second electrical wire inserted through the third side opening of said first upright annular flange and connected to said first annular metal cushion.

2. The electrical plug of claim 1 wherein said upper shell has a plurality of pin holes; and said bottom shell has a plurality of upright locating pins respectively fitted into the pin holes of said upper shell.

3. The electrical plug of claim 1 wherein said bottom shell further comprises two clamping flanges bilaterally disposed in the first cable hole, said clamping flanges having ribs configured to clamp on said electrical cable.

4. The electrical plug of claim 1 wherein said bottom shell further comprises a second upright annular flange extending around said first upright annular flange, said second upright annular flange having a fourth side opening, a second annular groove formed between said second upright annular flange and said first upright annular flange; a plurality of second upright rods disposed in said second annular groove; and a second annular metal cushion mounted within said second annular groove and supported on said second upright rods; wherein said electrical cable further comprises a grounding wire inserted through the fourth side opening of said second upright annular flange and connected to said second annular metal cushion; and wherein said rotary cap further comprises a third slot, and a grounding prong mounted in the rotary cap and extending through said third slot, the grounding prong having a T-shaped tail in contact with said second annular metal cushion.

5. The electrical plug of claim 4 wherein said bottom shell further comprises a plurality of spring members respectively mounted around said first upright rods and said second upright rods and supporting said first annular metal cushion and said second annular metal cushion above said first upright rods and said second upright rods.

6. The electrical plug of claim 4 wherein said rotary cap further comprises a plurality of raised portions located so as to press on said first annular metal cushion and said second annular metal cushion.

7. The electrical plug of claim 1 wherein said upper shell further comprises a plurality of tie holes disposed on an outside at spaced apart locations; and a lifting handle having portions engaging said tie holes.

8. The electrical plug of claim 4 wherein said first annular metal cushion and said second annular metal cushion each have a U-shaped cross section.

* * * * *